United States Patent [19]

Giakas

[11] 4,065,132

[45] Dec. 27, 1977

[54] MAZE PUZZLE

[76] Inventor: William Giakas, 2008 Grant Ave., South Plainfield, N.J. 07080

[21] Appl. No.: 658,762

[22] Filed: Feb. 17, 1976

[51] Int. Cl.[2] ..... A63F 9/08

[52] U.S. Cl. ..... 273/153 R

[58] Field of Search ..... 273/153 R, 156; 70/289, 70/290; 206/1.5

[56] References Cited

U.S. PATENT DOCUMENTS

| | | | |
|---|---|---|---|
| 174,842 | 3/1876 | Orr | 273/156 X |
| 430,261 | 6/1890 | Altemus | 273/156 X |
| 2,714,511 | 8/1955 | Derrig | 273/153 R |
| 3,819,187 | 2/1973 | Downs | 273/156 |
| 3,824,815 | 7/1974 | Darling | 70/290 |

*Primary Examiner*—Anton O. Oechsle
*Attorney, Agent, or Firm*—Abraham Wilson

[57] ABSTRACT

A maze puzzle comprising an outer cylinder on the inner surface of which is a trackway forming a maze which is solved by rotating and pushing an inner cylinder having a projection which slides in the trackway. In another version, the outer cylinder is segmented so that two or more segments can be interconnected randomly so that a different maze path is formed with each combination of segments. In still another version, using either the segmented or unsegmented outer cylinders, but dispensing with the inner cylinder, the puzzle is solved by causing a magnetically attractable ball to move along the maze as a magnetic slider is moved on the outer surface of the cylinder.

3 Claims, 6 Drawing Figures

MAZE PUZZLE

FIELD OF INVENTION

This invention relates to improvements in maze puzzles of the general type shown and described by U.S. Pat. No. 2,714,511 granted Aug. 2, 1955 to Donald J. Derrig.

DESCRIPTION OF PRIOR ART

In the aforementioned Derrig patent, the maze puzzle comprises an outer cylindrical container on whose inner surface there are a plurality of raised annular ribs which form trackways and which are connected by one or more transverse slots, which slots may also be blind stops. The entire inner surface constitutes a maze through which a path may be found from one end of the cylinder to the other. Through holes in end walls on the cylinder, a rotatable, axial shaft having a laterally extending arm which rides in the trackway can be made to progress from one end of the cylinder to the other by alternately riding within the annular ribs or axially down the transverse slots to complete the maze. Variations on this principle described in the Derrig patent are the use of a partially cutaway cylindrical container to allow viewing of the maze and the substitution of a hollow rotatable shaft mounted on a fixed axial rod for the single rotatable shaft mentioned above. It can be appreciated that manufacture of such a device involves a number of discrete fabrication and assembly steps.

Other maze puzzles are disclosed by the following U.S. Pat. Nos. 2,541,411 granted Feb. 13, 1951 to R. W. Culwell; 3,594,005 granted July 20, 1971 to Jorma Vennola and Pekka Korpijaakko; and 3,625,516 granted Dec. 7, 1971 to Martin J. Handweiler and Kenneth R. Wisner. This list is not intended to exhaust the prior art. None of these patents disclose a maze puzzle in which the rotatable element is itself a one piece cylinder which is one of the improvements I claim as my invention. In the Handweiler and Wisner U.S. Pat. No. 3,625,516 there is disclosed a magnet contained within the moveable stud which is used to slide within the track of a flat maze, which magnet causes a figure containing a magnetically attractable material to slide on the surface of the puzzle for a visual indication of the stud's progress through the maze. One variation of my invention discloses the principle of magnetic tracking for actual operation of the puzzle and not merely for the visual indication obtained by Handweiler and Wisner.

SUMMARY OF THE INVENTION

A principal object of the present invention is to provide a maze puzzle which is simple to manufacture from readily available materials in a few manufacturing steps, which, in a segmented version, can be readily converted to N! puzzles where N is the number of segments and which can be used without its inner cylinder but with a magnetically attractable ball and an external magnetic slider in a different mode of operation wherein movement of the magnetic slider causes the ball to move in the maze trackway.

In one embodiment of the invention, a maze is defined by a primary groove and a plurality of secondary grooves which are formed in a unitary and integral fashion on the cylindrical inner surface of a hollow container and which result in raised portions on the inner wall of said hollow container, said hollow container having at least one open end. The primary groove defines a serpentine path extending substantially between the ends of the container, while the secondary grooves intersect the primary groove and lead to blind stops, remote from the primary groove. There is an inner cylinder, dimensioned to telescope within said hollow container, having affixed thereon a follower means, as for example a laterally extending arm, which follower means extends into said primary and secondary grooves and is moveable therein. The inner cylinder, when moved within the hollow container guides the follower means through the maze and is removable from the container when the primary groove has been traversed.

In the preferred form of the invention, the maze results from trackways formed by annular ribs connected by transverse slots on the inner wall of a cylindrical container as in Derrig. The slideable element is a cylinder, easily formed in a one step manufacturing operation and confortable for a child to grasp, which is dimensioned to telescope and slide within the cylindrical container and having a laterally extending arm which is a short projection formed in the original manufacturing process. This arm rides in the trackway as the inner cylinder is rotated and pushed to make its way through the maze.

By making a segmented cylindrical container of which each segment can be attached to any other and in any order, and achieving alignment of the segments by fiduciary marks so as to provide a continuous maze pathway, I achieve a further improvement since each interchange of the segments produces a new maze path.

In the most preferred embodiment of this invention, there is a segmented container constructed with a plurality of elemental segments, each segment comprising a hollow, open-ended container with a cylindrical inner surface and having a maze defined by a primary groove and a plurality of secondary grooves which are formed in a unitary and integral fashion on the cylindrical inner surface of the hollow container and which result in raised portions on the inner wall of said hollow container. The primary groove of each segment defines a serpentine path extending substantially between the ends of the container, while the secondary grooves intersect the primary groove and lead to blind stops, remote from the primary groove. There is provided a means for detachably joining said segments whereby the inner surfaces thereof are in end-to-end coaxial alignment, defining a cylindrical inner surface for said segmented container. The segments are radially oriented with respect to each other so that the primary groove of each segment intersects the primary grooves of an adjoining segment at the juncture of said segments. Where desired, such orientation of the segments may be facilitated by a fiduciary indicator, as for example a fiduciary mark. There is an inner cylinder, dimensioned to telescope within said segmented container, having affixed thereon a follower means as described above for the unsegmented embodiment of the insertion. Similar to the unsegmented embodiment of the invention, the inner cylinder, when moved within the segmented container, guides the follower means through the maze and is removable from the segmented container when the primary grooves have been traversed.

In still another version of the puzzle, the inner cylinder may be eliminated completely. The tracking element is a magnetically attractable ball which, in combination with an external magnetic slider, may be caused to move in the trackway. When the magnetic slider is incorrectly moved, for example by the ball being moved into a blind stop, continued movement of the magnetic slider will move its magnetic field beyond its ball attracting range whereupon the ball will drop and the magnetic slider will no longer be held to the surface. The operator will then have to locate the ball which will be perceived by interaction with the magnetic slider which will then be held to the surface again. Alternatively, the end caps which are placed on the ends of the cylindrical container or the segmented cylindrical container to retain the ball may be made of a transparent material to permit visual observation of the maze and location of the ball.

BRIEF DESCRIPTION OF DRAWINGS

Referring now to the drawings.

DETAILED DESCRIPTION OF INVENTION

Figure 1:
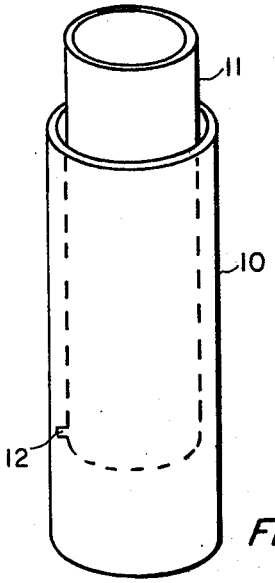
FIG. 1 is a perspective view of one form of my invention.

Referring now to FIG. 1, which shows the simplest form of my invention, I show the cylindrical container as 10 and the inner cylinder, which is rotatable and slideable and dimensioned to telescope within the cylindrical container, as 11. The method of operation of the puzzle may be understood by reference to FIG. 2. The inner cylinder 11 is inserted in the cylindrical container 10 by sliding it so that the laterally extending arm 12 goes into a transverse slot 13. The transverse slots 13 connect the horizontal trackways 14 which are formed as channels between the raised portions 15. Either transverse slots 13 or horizontal trackways 14 may at times terminate in blind stops 16. It will be recognized that this system of interconnected horizontal tracksways 14 with many blind stops 16 forms a maze puzzle which is solved by a combination of rotation and forward motion of the inner cylinder 11 whose laterally extending arm 12 slides between the raised portions 15. A solution of the puzzle is achieved when the inner cylinder 11 has traversed the entire length of the cylindrical container 10.

Figure 2:
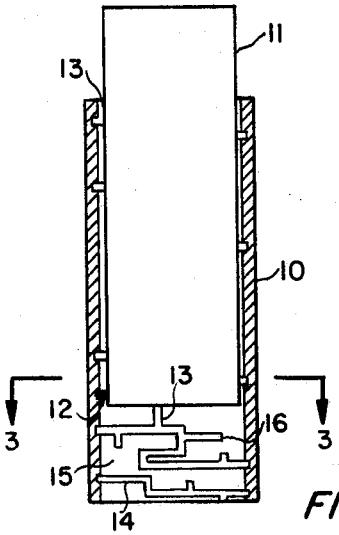
FIG. 2 is vertical sectional view of the form of the invention shown in FIG. 1.
Figure 3:
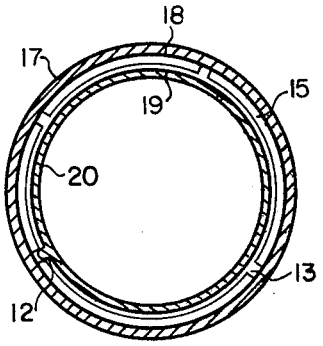
FIG. 3 is a horizontal section taken along the plane of the line 3—3 of FIG. 2.

Turning to FIG. 3, the cross section 3—3 of FIG. 2, we identify the outer wall of the cylindrical container 10 as 17, the inner wall of the cylindrical container 10 as 18, the raised portions as 15, the transverse slots 13, the laterally extending arm 12, 19, and the inner wall of the inner cylinder as the outer wall of the inner cylinder as a 20. Although the inner wall 18 of the cylindrical container 10 is shown as forming a discrete division between the cylindrical container 10 and the raised portions 15, it should be understood that the cylindrical container 10 may be manufactured by several different methods one of which may be a one piece molding technique in which the entire cylindrical container 10 including the maze is formed monolithically. Alternatively, the raised portions 15 may be formed separately and glued or solvent welded into the cylindrical container 10.

Figure 4:
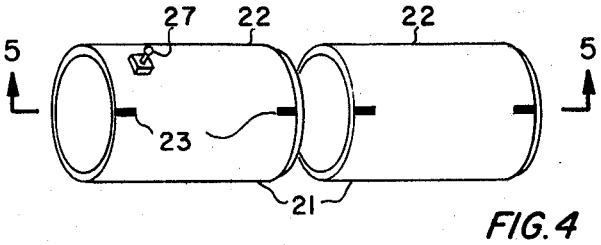
FIG. 4 is a perspective view of a further modification of my invention showing a segmented cylindrical container.
Figure 5:
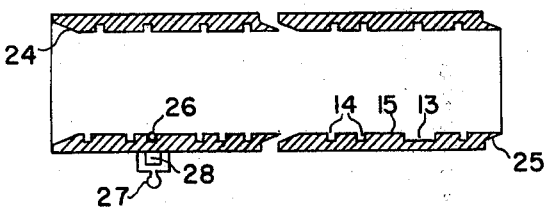
FIG. 5 is a vertical section taken along the plane of the line 5—5 of FIG. 4.

In FIG. 4 I show another form of my inventions which is a substantial improvement over the aforedescribed. In this form a segmented cylindrical container 21, consisting of two or more segments 22 replaces the single cylindrical container 10 described above. These segments 22 are constructed so that they fit into one another in any order so that a different maze puzzle results from every arrangement of the segments 22. Obviously, where the number of segments 22 is N, the number of different maze puzzles which can be achieved is N! . Each end of each segment 22 has a fiduciary mark 23 inscribed such that alignment of the fiduciary marks in assembling the segmented cylindrical container 21 will result in a completed maze path. For purpose of illustration only and not to be taken as an exclusive method of achieving coupling, FIG. 5 is illustrative of a method of coupling the segments 22. One end of each segment 22 is internally beveled to form a bell 24 while the other end is tapered at the angle of the bevel to form a spigot 25. When the spigot 25 of one segment 22 is inserted into the bell 24 of another segment 22, the frictional force is sufficient to hold the segments 22 together to form the assembled cylindrical container 21. The puzzle can then be operated in the conventional manner by inserting the inner cylinder 11 into the lead transverse slot 13 of the first segment 22 in the segmented cylindrical container 21.

Figure 6:
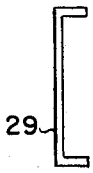
FIG. 6 is a sectional view of an end cap.

Another version of my invention which is novel and substantially different in operation than that which I have heretofore described may be understood from further examination of FIG. 5. In this version the inner cylinder 11 is not used. A magnetically attractable ball 26, dimensioned so as fit slideably into a horizontal trackway 14 or transverse slot 13 is placed into either of the above and held in place by a magnetic slider 27 placed on the surface of the cylindrical container 10 or the segmented cylindrical container 21. The magnetic force which holds the magnetically attractable ball 26 is obtained from a magnetic material 28 contained within the magnetic slider 27. To solve the maze puzzle, the operator moves the magnetic slider 27 while endeavoring to retain a perception of the magnetic force exerted by the magnetic slider 27 upon the magnetically attractable ball 26. If the operator should make a move which results in the magnetically attractable ball 26 being removed from the magnetic field, the magnetic slider 27 will disengage from the surface alerting the operator to his error. He will then relocate the magnetically attractable ball 26 by probing with the magnetic slider 27 until an interaction with the magnetic field is perceived. It is easily appreciated that this form of the puzzle will require a greater degree of skill in its operation and solution than the versions described above in which the inner cylinder 11 is used to traverse the maze. FIG. 6 is a cross section of an end cap 29, two of which would normally be provided with each puzzle. The end caps 29 are made so as to slide with a friction fit over the outer wall 17 of the cylindrical container 10 or over the segmented cylindrical container 21 and are used to prevent loss of the magnetically attractable ball 26. They may be made of either opaque or transparent material, in the latter case permitting the operator to locate the position of the magnetically attractable ball 26 visually.

It is obvious that this form of the puzzle is equally suitable for use with the segmented cylindrical container 21 or the simpler cylindrical container 10.

It is contemplated that ease of manufacture will be facilitated by the use of plastic as the material of construction for the outer and inner cylinders and end caps, but any material having the desired physical characteristics may be used.

I believe that the nature of my invention, its operation and its contribution to the art will now be clearly understood.

I claim:

1. An improved maze puzzle of the type wherein there is a cylindrical container whose inner wall has a plurality of spaced raised portions to form horizontal trackways with at least one transverse slot to connect the said trackways, said trackways and transverse slots being disposed to constitute a maze, said maze including a plurality of blind stops and having an axial shaft passing rotatably through end walls attached to the cylindrical container, which axial shaft has a laterally extending arm on said shaft, the outer end of the arm riding in one of the said trackways, wherein the improvement comprises:

a. An inner cylinder, replacing said axial shaft and end walls, dimensioned to telescope within said container, having a laterally extending arm slightly shorter than the depth of the raised portions, and being slideably insertable into the cylindrical container so that the laterally extending arm may ride in said trackway, said cylindrical container consisting of a plurality of segments, having fiduciary marks at each segment end, each segment being insertable into any other segment in random order such that, when the fiduciary marks are aligned, a completed maze puzzle is formed from one end of the assembled segmented cylindrical container to the other .

2. A puzzle comprising:

a segmented container constructed with a plurality of elemental segments, each of said segments comprising:

a hollow container, with a cylindrical inner surface, having first and second ends, and having openings disposed at said first and second ends;

a primary groove on said inner surface defining a serpentine path extending between said first and second ends;

a plurality of secondary grooves on said inner surface, each secondary groove intersecting said primary groove and having a blind stop remote from said primary groove;

means for detachably joining said segments with the inner surfaces thereof in end-to-end coaxial alignment to define a cylindrical inner surface for said segmented container;

said segments being radially oriented with respect to each other so that the primary groove of each segment intersects the primary groove of an adjoining segment at the juncture of said segments, the primary grooves of said segments cooperating to define a serpentine path substantially coextensive with said segmented container's cylindrical inner surface in an axial direction;

an inner cylinder dimensioned to telescope within said segmented container;

a follower means affixed to said inner cylinder and constructed and arranged to extend into said primary and secondary grooves and to be movable therein;

said primary and secondary grooves defining a maze on the cylindrical inner surface of said segmented container to guide said follower means through said maze so that said inner cylinder is removable from within said segmented container when said follower means has traversed said primary grooves.

3. The maze puzzle of claim 2 wherein there is a plurality of fiduciary indicators affixed on each segment to facilitate a radial orientation of said segments wherein the primary grooves of each segment intersects the primary groove of an adjoining segment at the juncture of said segments.

* * * * *